US011723831B2

(12) United States Patent
Zhijian

(10) Patent No.: US 11,723,831 B2
(45) Date of Patent: Aug. 15, 2023

(54) ADJUSTABLE MASSAGE STRUCTURE AND MASSAGE BACKPACK

(71) Applicant: Li Zhijian, Fuzhou (CN)

(72) Inventor: Li Zhijian, Fuzhou (CN)

( * ) Notice: Subject to any disclaimer, the term of this patent is extended or adjusted under 35 U.S.C. 154(b) by 0 days.

(21) Appl. No.: 17/575,930

(22) Filed: Jan. 14, 2022

(65) Prior Publication Data

US 2022/0168178 A1 Jun. 2, 2022

Related U.S. Application Data

(63) Continuation of application No. 17/486,988, filed on Sep. 28, 2021, now abandoned, which is a continuation of application No. 16/693,259, filed on Nov. 23, 2019, now Pat. No. 11,426,324, which is a continuation of application No. 16/850,043, filed on Apr. 16, 2020, now Pat. No. 11,344,469, which is a continuation of application No. 16/885,324, filed on May 28, 2020, now Pat. No. 11,337,887, which is a continuation of application No. 17/149,806, filed on Jan. 15, 2021.

(60) Provisional application No. 62/834,551, filed on Apr. 16, 2019.

(30) Foreign Application Priority Data

Oct. 5, 2021 (CN) ..... 202111240999.3

(51) Int. Cl.

| | |
|---|---|
| ***A61H 23/02*** | (2006.01) |
| ***A45F 3/04*** | (2006.01) |
| ***A45F 3/00*** | (2006.01) |

(52) U.S. Cl.

CPC ..... *A61H 23/02* (2013.01); *A45F 3/04* (2013.01); *A45F 2003/003* (2013.01); *A45F 2003/045* (2013.01); *A61H 2201/1207* (2013.01); *A61H 2201/165* (2013.01); *A61H 2201/1626* (2013.01); *A61H 2201/5007* (2013.01); *A61H 2201/5043* (2013.01); *A61H 2205/081* (2013.01)

(58) Field of Classification Search

CPC ..... A61H 23/02; A45F 3/04
USPC ..... 224/576
See application file for complete search history.

(56) References Cited

U.S. PATENT DOCUMENTS 5,449,102 A * 9/1995 Sason ..... A45F 3/047 224/632
D396,746 S * 8/1998 Correale ..... D3/217
(Continued)

*Primary Examiner* — Nathan J Newhouse
*Assistant Examiner* — Lester L Vanterpool
(74) *Attorney, Agent, or Firm* — Jennifer Meredith, Esq.; Meredith Attorneys, PLLC

(57) ABSTRACT

An adjustable massage structure having a back panel and at least one shoulder strap set on the back panel, the back panel having a connected upper part and a lower part, an upper end of the at least one shoulder strap is connected to the back panel at a position set on the connection line of the upper part and the lower part of the back panel, the lower end of the at least one shoulder strap is connected to the lower part of the back panel by a first webbing, the at least one shoulder strap is provided with a massage head inside, the at least one shoulder strap and the upper part of the back panel is connected with a second webbing for adjustment of the shoulder strap, the second webbing is provided with a second adjustment part for adjusting the length of the second webbing.

10 Claims, 5 Drawing Sheets

(56) References Cited

U.S. PATENT DOCUMENTS 6,107,495 A * 8/2000 Cazaux ..... C07D 333/20 549/76
6,109,495 A * 8/2000 Hernandez ..... A45F 3/04 224/264
6,626,341 B2 * 9/2003 Mitchell ..... A45F 3/04 224/644
6,802,442 B1 * 10/2004 Thompson ..... A45F 3/047 224/259
8,172,117 B2 * 5/2012 Maggi ..... A45F 3/047 224/604
8,893,940 B2 * 11/2014 Green ..... A45F 3/08 224/604
9,888,761 B2 * 2/2018 Kao ..... A45F 3/047
10,561,225 B2 * 2/2020 Parekh ..... A45F 3/047
10,617,194 B2 * 4/2020 Rogers ..... A45F 3/08
10,806,238 B2 * 10/2020 Sears ..... A45F 3/08
10,888,494 B2 * 1/2021 Zhijian ..... A45C 15/00
11,344,469 B2 * 5/2022 Zhijian ..... A61H 15/0078
11,426,324 B2 * 8/2022 Zhijian ..... A61H 23/02
2002/0170932 A1 * 11/2002 Higgins ..... A45F 3/04 224/628
2006/0131355 A1 * 6/2006 Tate ..... A45F 3/047 224/637
2012/0031936 A1 * 2/2012 Hairston ..... A45F 3/04 224/153
2013/0001268 A1 * 1/2013 Hairston ..... A45F 3/04 156/305
2013/0221051 A1 * 8/2013 Hairston ..... A45C 13/04 156/305
2014/0224854 A1 * 8/2014 Asokaraj ..... A45C 15/00 224/576
2015/0189974 A1 * 7/2015 Bercaw ..... A45F 3/04 224/633
2017/0027806 A1 * 2/2017 Lin ..... A45F 4/02
2018/0255910 A1 * 9/2018 Tiblas ..... A45F 3/047
2019/0307232 A1 * 10/2019 Nagai ..... A45F 3/04
2019/0374012 A1 * 12/2019 Chang ..... A45F 3/02
2020/0222278 A1 * 7/2020 Zhijian ..... A41D 1/04

* cited by examiner

ADJUSTABLE MASSAGE STRUCTURE AND MASSAGE BACKPACK

TECHNICAL FIELD

The present invention relates to the field of backpacks, in particular, an adjustable massage structure and massage backpack for a close fit. After a series of innovative, fully considering the scientific, ergonomic and other factors, composite innovated the detailed sizes and structures, invented a more close-fitting, adjustable special and comfortable effect of the massage backpack.

BACKGROUND TECHNOLOGY

Existing backpacks provide convenience for people to carry items on their trips, but still have the following defects: due to the weight of the items in the backpack, the backpackers shoulders, back and waist are under pressure, and over time, the backpacker will feel uncomfortable and prone to fatigue and pain, which damages the user's health. With the advancement of technology, backpacks with massage function have been designed on the traditional backpack. The existing massage backpack is generally installed on the shoulder straps, and the massage position of the massage head is mostly by adjusting the elasticity of the shoulder straps to carry out, in the process of adjusting the elasticity of the shoulder straps in the backpack the up and down position on the human back also changed at the same time, the use experience is compromised, and only using the shoulder strap structure, the massage head and the human shoulder is not fit enough, massage effect is poor.

CONTENT OF THE INVENTION

The purpose of the present invention is: to overcome the above shortcomings to provide an adjustable massage structure and massage backpack, the massage structure and massage backpack will be separated into the upper and lower back panel, and the upper part of a second set of webbing can be adjusted to the massage position of the massage head, and the second webbing on the shoulder straps to play a pulling role, so that the massage head can fit more closely with the human shoulder and back, massage effect is good.

The present invention is realized through the following technical solutions. Solution I. An adjustable and fit massage structure comprising a back panel and a shoulder strap set on the back panel, wherein the back panel further comprising a connected upper part and a lower part, the upper end of the shoulder strap being connected to the back panel at a position set on the connection line between the upper part and the lower part of the back panel, wherein the lower end of the shoulder strap being connected to the lower part of the back panel through a first webbing, the height h of the back panel being: $h \geq 390$ mm, the height d of the upper part being: 110 mm$\leq d \leq$147 mm.

Wherein the shoulder strap is provided with a massage head for back and shoulder massage inside, the shoulder strap is connected to the upper part of the back panel with a second webbing for adjusting the shoulder strap and the position of back and shoulder massage, wherein the second webbing is provided with a second adjustment part for adjusting the length of the second webbing.

Preferably, the number of shoulder straps is two and spaced along the width direction of the back panel. Preferably, wherein the second adjusting part is ladder buckle. In order to allow the second webbing to be adjusted to maintain accurate positioning of the back strap moving up and down, and not to induce left and right shaking, and when tightening, it will not resulting a reduced degree of intimacy, the two ends of the second webbing and the second adjustment part are close and located on the substantially same vertical surface.

In order to facilitate the installation of the massage head, the shoulder strap is provided with a storage space for the installation of the massage head, wherein the storage space is provided with a first opening on one side to facilitate the massage head and cable through it, the storage space is elastic and fastened to the outer circumference of the massage head.

In order to facilitate the disassemble of the massage head, the side wall of the shoulder strap is provided with a second opening for opening and closing the internal space of the shoulder strap, wherein the second opening is closed and connected by fasteners. Preferably, the shoulder strap is also provided with a fastening device to hold the second webbing to reduce noise, the fastening device can be an elastic band or Velcro.

Solution II. A massage backpack comprising the fit adjustable massage structure described in Solution I and a bag body connected thereto, the bag body being fixed or detachably connected to the back panel. Compared with the prior technology, the beneficial effects of the present invention are. 1. the invention provides a close-fitting, adjustable massage structure and massage backpack, the massage structure and massage backpack comprises an upper and a lower part on the back panel, with a special size setting, and a second webbing set in the upper part can be adjusted to the massage position of the massage head, and the second webbing on the shoulder straps to play a pulling role, so that the massage head can fit more closely with the human shoulder and back position, through these multi-point organic coordination combinations makes, massaging effect getting better. And the invention and innovation of this product size, that is, the scientific combination of the back panel height and the upper part height size, is an important factor to achieve the effect of invented massaging backpack. 2. The present invention provides a fit and adjustable massage structure and massage backpack, wherein the two ends of the second webbing and the second adjustment component are close and located on the substantially same vertical surface. This way the second webbing can keep the positioning of the backpack moving up and down accurately when adjusting, without creating left and right shaking. It will not cause a gap between the back of the main body and the shoulder or back of the human body, when tighter the webbing which form a deviation. 3. The present invention provides a snug and adjustable massage structure and massage backpack, wherein an opening is set at the side of the shoulder strap and an elastic storage pocket is set inside the shoulder strap to facilitate the disassemble and assemble of the massage head. 4. The invention provides an adjustable massage structure and massage backpack, the massage structure and other parts of the backpack are independent structures, later the entire back system can be sewn directly to other parts to complete the backpack sewing, which can improve production efficiency.

DESCRIPTION OF THE ATTACHED DRAWINGS

Figure 1:
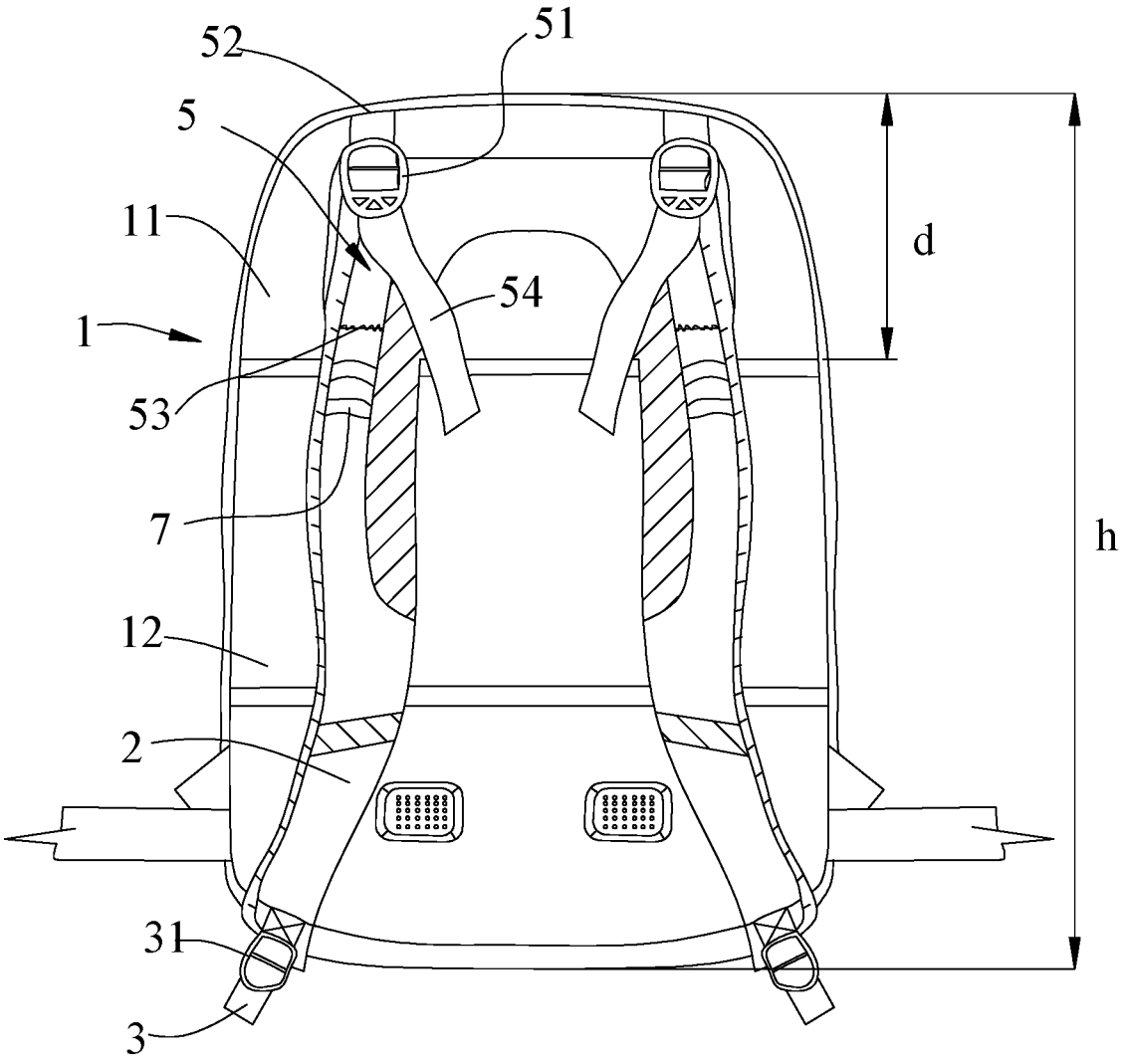
FIG. 1 is a schematic diagram I of the structure of implementation I of the present invention.

Description of the marks: 1—back panel, 11—upper part, 12—lower part, 2—shoulder straps, 21—second opening, 3—first webbing, 31—first adjustment part, 4—massage head, 5—second webbing, 51—second adjustment part, 52—upper stitching, 53—lower stitching, 54—protruding section, 55—upper section, 56—a lower section, 6—storage pocket, 61—first opening, 7—fastening part, 8—fasteners.

Specific Implementations

The present invention is described in detail below in conjunction with the accompanying illustrations.

As shown in FIGS. 1-5, a close-fitting and adjustable massage structure, mainly comprising a back panel 1 and a shoulder strap 2 set on the back panel 1, mentioned back panel 1 comprises a connected upper part 11 and a lower part 12, the upper end of the shoulder strap 2 is connected to the back panel 1 at a position set on the connection line of the upper part 11 and the lower part 12 of the back panel 1, wherein the lower end of the shoulder strap 2 is connected to the lower part 12 of the back panel 1 through a first webbing 3, mentioned first adjustment component 31 for adjusting the length of the first webbing 3 is also provided between the first webbing 3 and the shoulder strap 2, the height h of the back panel 1 being: h≥390 mm, the height d of the upper part 11 being: 110 mm≤d≤147 mm. For the value of h, h explains and limits a reasonable size of the back panel of a backpack used by people from high school students to other ages of adults. The general adaptability of this size backpack is for 1) go to school, 2) commute; 3) travel. This kind of backpack users need to bear weight for a long time. The present invention aims at this specific demand, and fully considers the adult's height, back height, back thickness and other factors to create the value of h to achieve massage backpack products in reasonable range of back sizes. In order to improve the relatively complex structure, high cost and heavier weight of the product described in previous inventions, the present invention provides an innovative and new approach, namely: to have the shoulder strap stitch directly to the back panel of the backpack. If the size of this approach is not reasonable enough, it will cause a gap between the massage head on the strap and the area that needs to be massaged (from the upper back to the shoulders). After much research and testing it was discovered that having a huge number of people in different heights, body types, and back thicknesses, a solution is to find a common divisor and methods to create the best and suitable structures for a multitude of sizes for people of different body types, which can also form a tight-fitting effect, so as to achieve the best goal of good massage effect. As a result, we innovated the structure and size range of d. Only in this interval, our massage products can best match the body thickness of most adults people to achieve a better comfortable massage effect. The design of the second adjustment part (51), upper stitching (52), lower stitching (53), and protruding section (54), combined with the best size of d, achieves that the back panel of the massage backpack can be used by a multitude of people, which is comfortable and effective. A key point of the invention is: d is the best numerical range that we have verified through countless experiments and verifications during the past 2 years. This is not a numerical range that can be calculated by the existing formulas, this is an important invention which be created by now. At the same time, this innovative product will have a more scientific and effective massage effect. Therefore, this is part of the extended innovation and continuous innovation of the applicants massage creations. It is the result of creative invention that has been obtained through rounds of experiments, revisions, retests, and revisions. Wherein the shoulder strap 2 is provided with a massage head 4 for back and shoulder massage inside, mentioned shoulder strap 2 is connected to the upper part 11 of the back panel 1 with a second webbing 5 for adjusting the position of the shoulder strap 2 and back and shoulder massage, the second webbing 5 is provided with a second adjusting part 51 for adjusting the length of the second webbing 5. The height h of the mentioned back panel 1 and the height d of the upper part 11 are the dimensions of the product after stitching. It is noted the invention may be just at least one shoulder strap without departing from the present invention. Preferably, the number of mentioned shoulder straps 2 is two and spaced along the width direction of the back panel 1.

Figure 2:
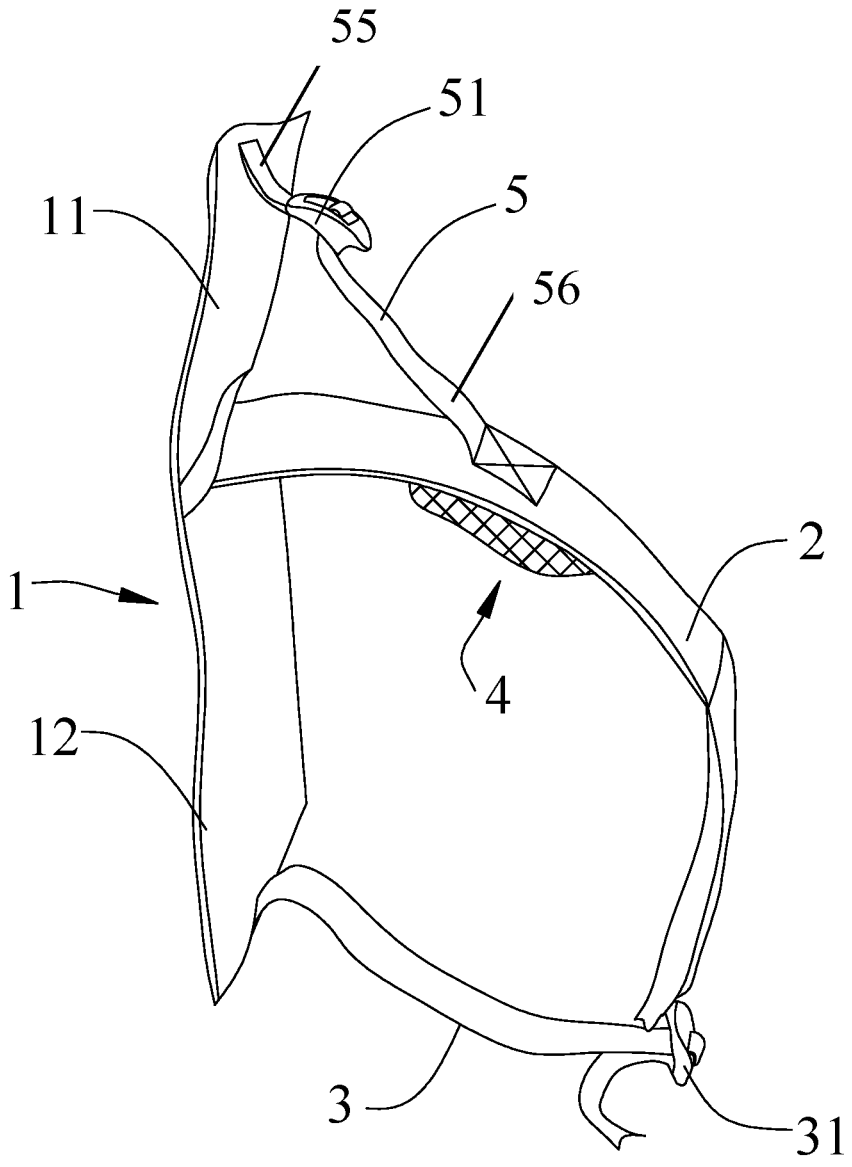
FIG. 2 is a schematic diagram of the structure of implementation I of the present invention II.

As shown in FIGS. 1-2, in order to facilitate the adjustment of the length of the webbing, the first adjustment part 31 and the second adjustment part 51 are both ladder buckles. This implementation uses the ladder buckle for the adjustment of the webbing, but it is not limited to the ladder buckle, but can also be other adjustment devices, such as belt-type pin and hole connection structure, or pawl and tooth slot mating structure.

As shown in FIG. 2, in order to make the best massage effect and the best fit with the human body, and the second webbing can be adjusted to keep the positioning of the back belt moving up and down accurately, and will not induce left and right shaking, the two ends of the second webbing 5 and the second adjustment component 51 are close and located on the substantially same vertical surface. As shown in FIG. 1, that is, the upper end seam 52, the lower end seam 53 and the second adjustment part 51 of the second webbing 5 are close and located on the substantially same vertical surface.

Figure 3:
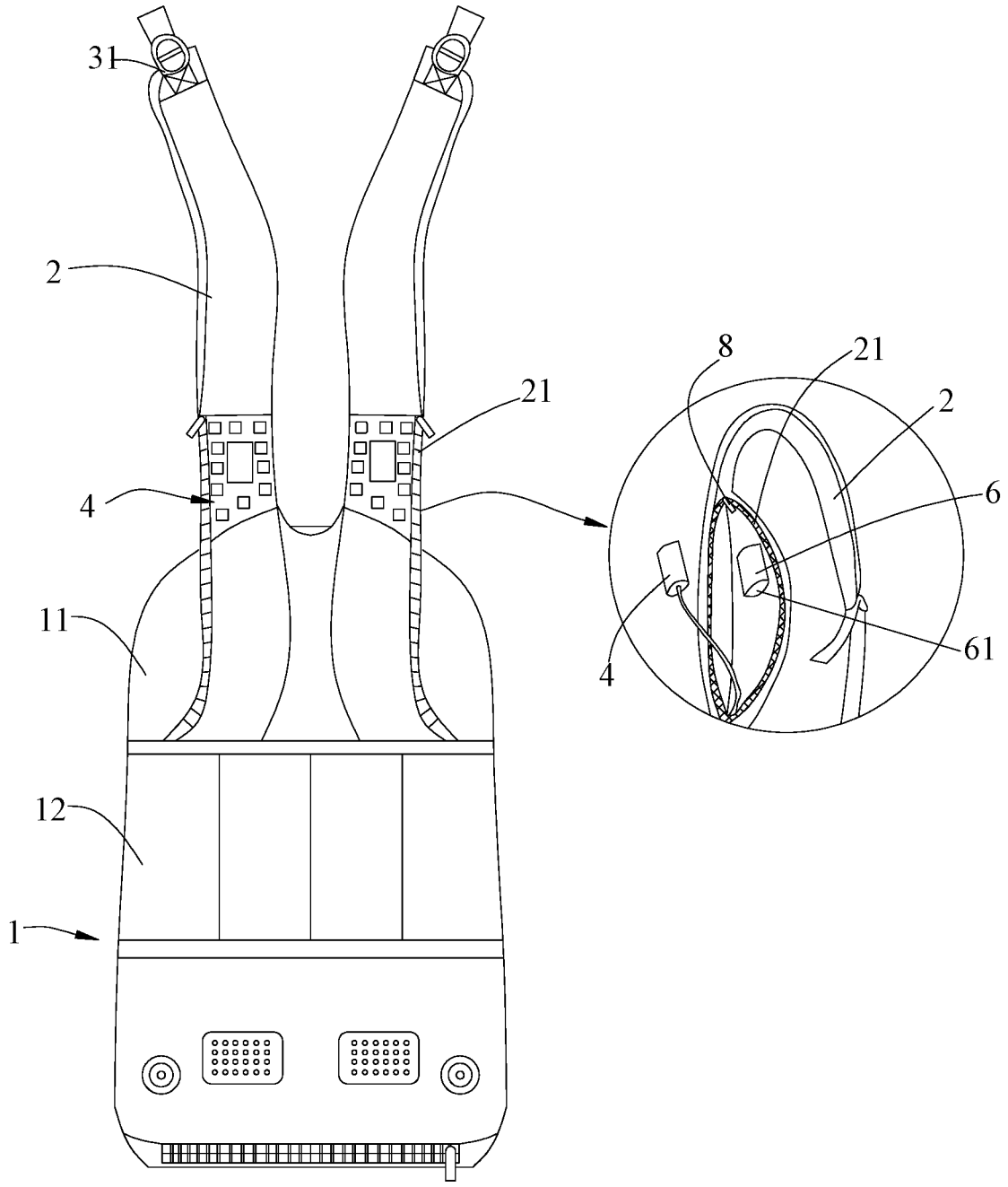
FIG. 3 is a schematic diagram of the structure of implementation I of the present invention III.

As shown in FIG. 3, in order to facilitate the installation of the massage head, the interior of the shoulder strap 2 is provided with a storage space 6 for the installation of the massage head 4, the storage space 6 is provided with a first opening 61 on one side to facilitate the massage head 4 and cable penetration into it, the storage space 6 is elastic and fastened to the outer circumference of the massage head.

As shown in FIG. 3, in order to facilitate the disassemble of the massage head, the side wall of the shoulder strap 2 is provided with a second opening 21 for opening and closing the internal space of the shoulder strap 2, mentioned second opening 21 through the fastener 8 to close the connection. This implementation of the fastener 8 is a zipper assemble, but also can be a dual lock, Velcro or other matching connection structure.

In order to fix the end of the second webbing to reduce noise, the shoulder strap 2 is also provided with a fastening part 7 that holds the second webbing 5 in place to reduce noise, and the fastening device 7 may be an elastic band or Velcro. As shown in FIG. 1, the second webbing 5 outstretched section 54 can be fixed by the fastening device 7 to prevent the massage head in the vibration process to drive the outstretched section 54 resonance to reduce noise.

With reference to the FIGS. 1-5, an adjustable massage structure is provided, having a back panel (1) and at least one shoulder strap (2) set on the back panel (1), wherein the back panel (1) further comprises a connected upper part (11) and a lower part (12), wherein the upper end of the at least one shoulder strap (2) is connected to the back panel (1) at a position set on the connection line of the upper part (11) and the lower part (12) of the back panel (1), wherein the lower end of the at least one shoulder strap (2) is connected to the lower part (12) of the back panel (1) by means of a first webbing (3), wherein the at least one shoulder strap (2) is provided with a massage head (4) inside, wherein the at least one shoulder strap (2) and the upper part (11) of the back panel (1) is connected with a second webbing (5) for adjustment of the shoulder strap (2), wherein the second webbing (5) is provided with a second adjustment part (51) for adjusting the length of the second webbing (5). There may be two shoulder straps (2) spaced along the width of the backboard (1). The second adjustment part (51) may be a ladder buckle (as shown in FIG. 1). The ends of the second webbing (5) and the second adjustment part (51) are located on a substantially vertical surface, wherein the second webbing (5) is divided into two sections, an upper section (55) and a lower section (56), wherein the upper section (55) and the lower section (56) are integrated through the second adjustment part (51). The interior of the shoulder strap (2) is provided with a storage space (6) for the installation of the massage head (4). A side wall of the shoulder strap (2) is provided with a second opening (21) for opening and closing the internal space of the shoulder strap (2), wherein the second opening (21) is connected by fasteners (8) for closure. The shoulder straps (2) may also be provided with a fastening part (7) to hold the second webbing (5) to reduce noise, the fastening part (7) is an elastic band or Velcro.

The massage structure close-fitting to users body and adjustable structure, with a bag body connected thereto, wherein the bag body being fixed or detachably connected to the back panel. The height h of the back panel (1) being greater than or equal to 390 mm, and the height d of the upper part (11) being greater than or equal to 110 mm and less than or equal to 147 mm. The storage space (6) is provided with a first opening (61) on one side to facilitate the massage head (4) and cable through it. The storage space (6) is elastic and fastened to the outer circumference of the massage head (4).

Figure 4:
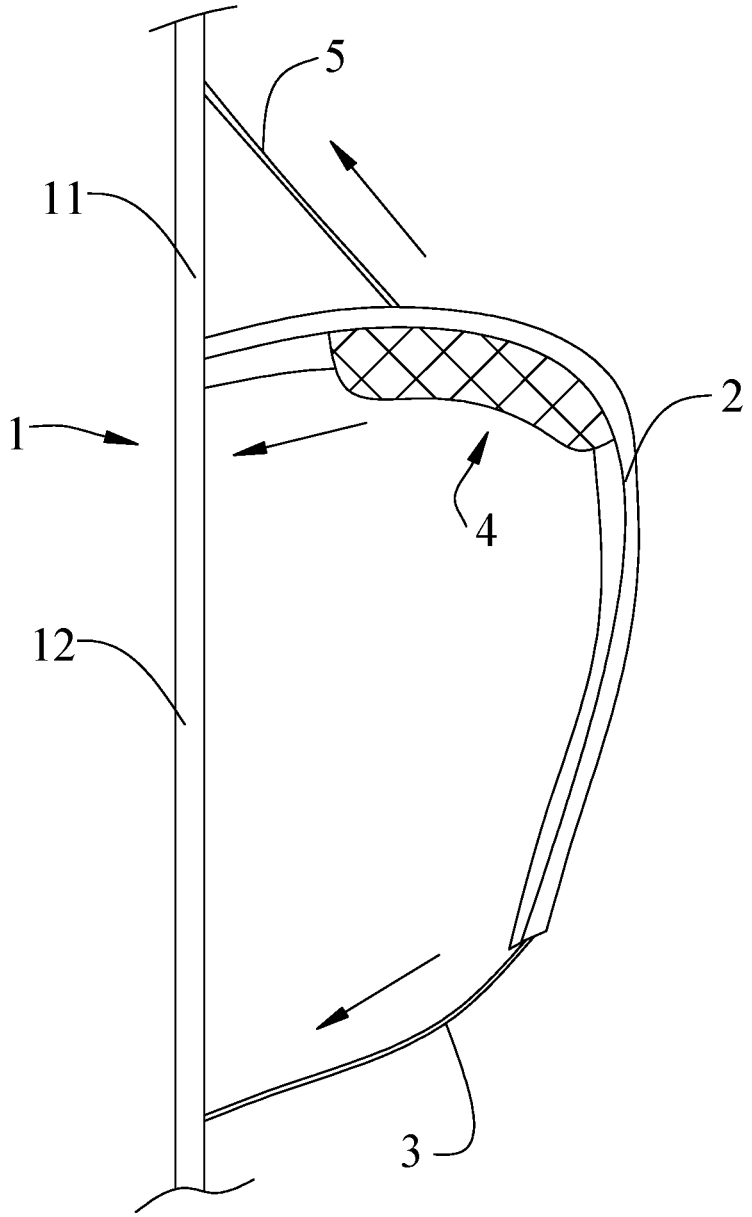
FIG. 4 is a schematic diagram I of the use state of implementation I of the present invention
Figure 5:
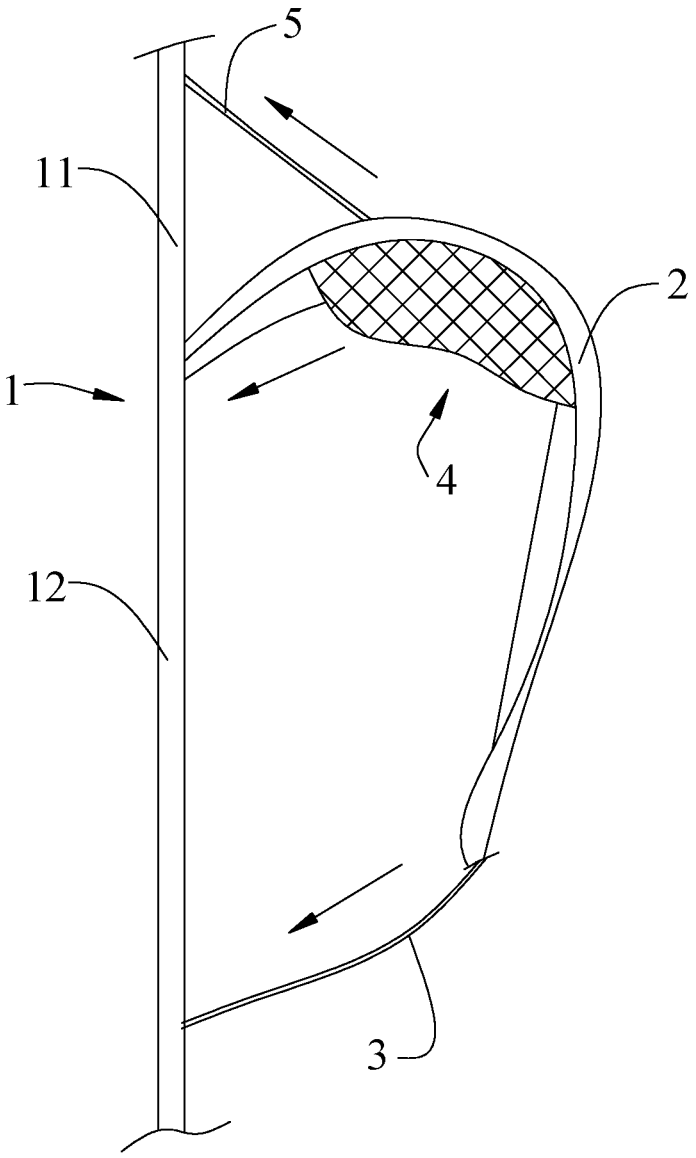
FIG. 5 is a schematic diagram of the use state of implementation I of the present invention II.

The working principle and process of this implementation are as follows. As shown in FIGS. 1-5, wherein the connection position of shoulder straps 2 and the back panel 1 will divide its back panel 1 into the upper part 11 and lower part 12, and the lower part 12 connected with the first webbing 3 is mainly used to adjust the position of backpack to fit on the human body, while adjusting the massage head 4 and the general position of the human shoulder and back, tighten the second webbing 5 can further adjust the massage head 4 on right position of human shoulder position, while the second webbing 5 provide the shoulder straps 2 upward tilting pulling force as shown in FIGS. 4-5, while under the gravity of the backpack, the ends of the shoulder straps are also pulled, so that the massage head 4 and the shoulder fully fit closely, to enhance the massage experience of the user in the case of backpack. Among them, the size of the innovative d is crucial to the closeness of the massage head.

Implementation II. As shown in FIGS. 1-5, a massage backpack, comprises a snug and adjustable massage structure described in implementation I and a bag body connected thereto, wherein the bag body being fixedly or detachably connected to the back panel. Although the present invention is illustrated and described using specific implementations and alternatives thereto, it should be understood that various variations and modifications may be implemented as long as they do not depart from the spirit of the present invention. Accordingly, it should be understood that the present invention is not limited in any sense except by the accompanying claims and their equivalents.

I claim:

1. An adjustable massage structure, comprising:

a back panel having a height h and a width; and at least one shoulder strap attached to the back panel, wherein the back panel comprises an upper part having a height d and a lower part having a height h-d, wherein the upper part is connected with the lower part along a connection line, wherein an upper end of the at least one shoulder strap is connected to the back panel at a position set on the connection line of the upper part and the lower part of the back panel, wherein a lower end of the at least one shoulder strap is connected to the lower part of the back panel by a first webbing, wherein the at least one shoulder strap is provided with a massage head inside, wherein the at least one shoulder strap and the upper part of the back panel are connected with a second webbing for adjustment of the shoulder strap, wherein the second webbing is provided with an adjustment part for adjusting the length of the second webbing, and wherein the second webbing has an upper section and a lower section and the lower section is affixed to the at least one shoulder strap opposite the massage head, wherein the height h of the back panel is greater than or equal to 390 mm, and the height d of the upper part is greater than or equal to 110 mm and less than or equal to 147 mm.

2. An adjustable massage structure according to claim 1, comprising two shoulder straps spaced along the width of the back panel.

3. An adjustable massage structure according to claim 1, wherein the adjustment part is a ladder buckle.

4. An adjustable massage structure according to claim 1, wherein the upper section and the lower section are integrated through the adjustment part.

5. An adjustable massage structure according to claim 1, wherein the interior of the shoulder strap is provided with a storage space for the installation of the massage head.

6. An adjustable massage structure according to claim 5, wherein a side wall of the shoulder strap is provided with an opening for opening and closing the storage space of the shoulder strap, wherein the opening is connected by fasteners for closure.

7. An adjustable massage structure according to claim 1, wherein the shoulder strap is also provided with a fastening part to hold the second webbing to reduce noise, wherein the fastening part is an elastic band or Velcro.

8. An adjustable massage structure according to claim 1, further comprising a bag body connected to the back panel in a fixed or detachable manner.

9. An adjustable massage structure according to claim 1, wherein a storage space is provided in the shoulder strap with a first opening on one side to facilitate the massage head and a cable through it.

10. An adjustable massage structure according to claim 9, wherein the storage space is elastic and fastened to an outer circumference of the massage head.

* * * * *